United States Patent [19]

Derichs

[11] Patent Number: 4,574,582

[45] Date of Patent: Mar. 11, 1986

[54] SPINNING DEVICE

[75] Inventor: Josef Derichs, Monchen-Gladbach, Fed. Rep. of Germany

[73] Assignee: W. Schlafhorst & Co., Monchen-Gladbach, Fed. Rep. of Germany

[21] Appl. No.: 593,036

[22] Filed: Mar. 23, 1984

[30] Foreign Application Priority Data

Mar. 26, 1983 [DE] Fed. Rep. of Germany ..... 3311141

[51] Int. Cl.[4] ..... D01H 7/882; D01H 1/135

[52] U.S. Cl. ..... 57/401; 57/327; 57/336

[58] Field of Search ..... 57/401, 334, 400, 336, 57/328, 327

[56] References Cited

U.S. PATENT DOCUMENTS

| | | | |
|---|---|---|---|
| 3,132,465 | 5/1964 | Putnam | 57/401 |
| 3,635,006 | 1/1972 | Fehrer | 57/401 |
| 4,051,653 | 10/1977 | Mitteregger | 57/401 |
| 4,202,163 | 5/1980 | Turk et al. | 57/401 |

FOREIGN PATENT DOCUMENTS

| | | | |
|---|---|---|---|
| 2480799 | 10/1981 | France | 57/401 |

*Primary Examiner*—John Petrakes

*Attorney, Agent, or Firm*—Herbert L. Lerner; Laurence A. Greenberg

[57] ABSTRACT

A spinning device for producing an at least partially twisted spun thread formed of spinning fibers, includes a perforated drum having a given axis of rotation about which the drum rotates in a given direction, a suction device disposed at least partially in the drum having at least one suction opening formed therein extended substantially parallel to the given axis of the drum, a device disposed opposite the at least one suction opening outside the drum for forming a wedge-shaped path for the spinning fibers, a device for conducting flying spinning fibers to the wedge-shaped path, and a device for withdrawing a spun thread substantially parallel to the axis of the drum, the wedge-shaped path forming device including an endless transport belt moving in a direction opposite the given direction at a distance from the drum during spinning.

8 Claims, 5 Drawing Figures

SPINNING DEVICE

The invention relates to a spinning device for producing an at least partially twisted thread formed of spinning fibers, including a rotating, perforated drum, a suction device provided in the interior of the drum with at least one suction opening disposed substantially parallel to the axis of the drum, and a wedge forming device disposed opposite the suction opening outside the drum, the flying spinning fibers being conducted into the wedge forming device and a spun thread being withdrawn approximately parallel to the axis of the drum.

A disadvantage of spinning devices of this type is that the spun thread is unevenly formed to an undesirable degree, as is especially noticeable with finer threads. Although the uniformity of the thread is less important than its strength with thicker threads, due to the out of round running of the perforated drum, the thread still loses the desired uniform contact with the drum or the wedge forming device, so that in this case as well the spinning result is unsatisfactory.

It is accordingly an object of the invention to provide a spinning device which overcomes the hereinafore-mentioned disadvantages of the heretofore-known devices of this general type, and especially to permit the spinning of very fine yarns.

With the foregoing and other objects in view there is provided, in accordance with the invention, a spinning device for producing an at least partially twisted spun thread formed of spinning fibers, comprising a perforated drum having a given axis of rotation about which the drum rotates in a given direction, a suction device disposed at least partially in the drum having at least one suction opening formed therein extended substantially parallel to the given axis of the drum, means disposed opposite the at least one suction opening outside the drum for forming a wedge-shaped path for the spinning fibers, means for conducting flying spinning fibers to the wedge-shaped path, and means for withdrawing a spun thread substantially parallel to the axis of the drum, the wedge-shaped path forming means including an endless transport belt moving in a direction opposite the given direction while kept at a distance from the drum during spinning.

The advantages obtained with the invention are in particular that a good spinning result is obtained without extreme requirements for very precise dimensioning, for high surface quality, or for true running or bearing support of the perforated drum or the wedge forming device.

In accordance with another feature of the invention, a portion, strand or trunk of the transport belt adjacent the drum moves in a direction forming a longitudinal dihedral crossing angle with the direction of movement of portions of the surface of the drum adjacent the transport belt.

In accordance with a further feature of the invention, a part of the transport belt with a given width acts on the thread, and the suction opening is wider than the given width. In accordance with an added feature of the invention, the transport belt has a side facing away from the drum, and including an aero-static support disposed at the side of the transport belt opposite the drum.

In accordance with an additional feature of the invention, the aero-static support includes a plate having chambers formed therein subdividing the plate with openings formed in one side of the plate directed toward the side of the transport belt, and means for supplying compressed air to the chambers.

In accordance with again another feature of the invention, the wedge-shaped path has an inlet as seen in fiber travel direction, and the conducting means are in the form of a fiber guidance channel disposed at the path inlet, the fiber guidance channel having an outlet end disposed in the wedge-shaped path and directed toward the transport belt.

In accordance with again a further feature of the invention, the fiber guidance channel includes a plate disposed at the outlet, ending in the wedge-shaped path and covering part of the perforated drum.

In accordance with a concomitant feature of the invention, the wedge-shaped path is defined by the drum, the transport belt and the conducting means.

The formation of the thread is improved by using a crossing angle and also by providing a sufficiently wide dimension of the suction opening. The aero-static support can be constructed in various ways. The transport belt does not have any contact with the aero-static support during the spinning operation, so that there is no friction wear. The air escaping from the aero-static support does not interfere with the spinning operation because it is discharged at the back of the transport belt.

In order to avoid disturbances in the formation of the thread, the fiber guidance channel is provided with an apron plate at the termination thereof which ends in the wedge-shaped region.

Other features which are considered as characteristic for the invention are set forth in the appended claims.

Although the invention is illustrated and described herein as embodied in a spinning device, it is nevertheless not intended to be limited to the details shown, since various modifications and structural changes may be made therein without departing from the spirit of the invention and within the scope and equivalents of the claims.

The construction and method of operation of the invention, however, together with additional objects and advantages thereof will be best understood from the following description of specific embodiments when read in connection with the accompanying drawings, in which.

Figure 1:
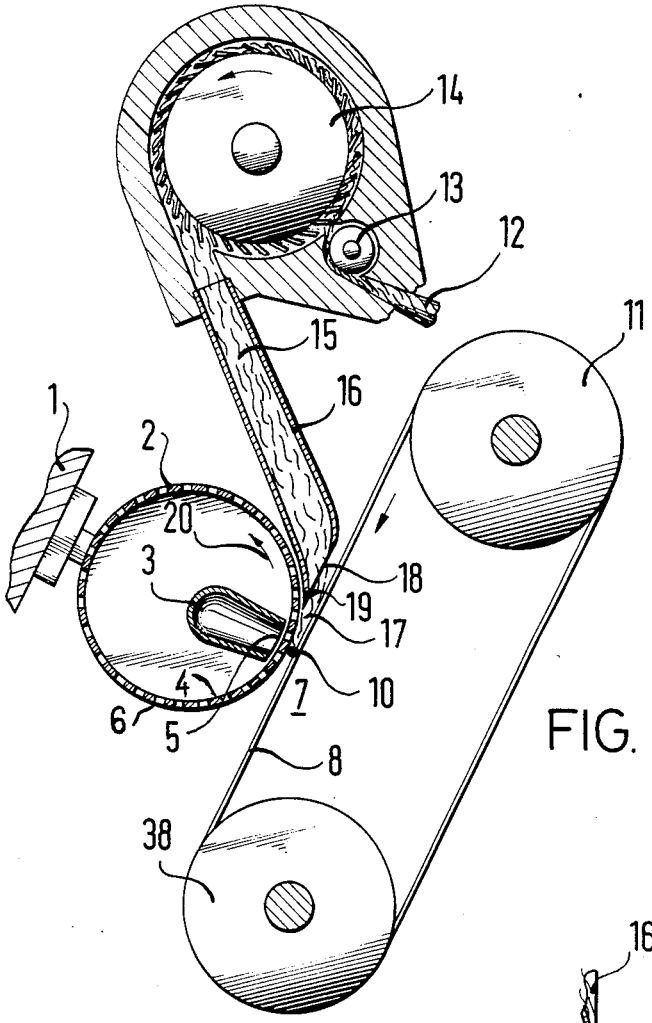
FIG. 1 is a fragmentary, diagrammatic, cross-sectional view of the device of the invention.

Referring now to the figures of the drawing in detail, and first particularly to FIG. 1 thereof, there is seen a spinning device which is designated as a whole with reference numeral 1 and includes a rotating perforated drum 2. The interior of the drum 2 is provided with a suction device 3 which has a suction opening 5 directed toward the inner wall 4 of the drum 2.

A wedge forming device which is designated as a whole with reference numeral 7, is disposed opposite the suction opening 5, at a distance from an outer wall 6 of the drum 2. In a more narrow sense, the wedge forming device is constructed in the form of an endless conveyor belt 8. The transport belt 8 runs over a drive roller 38 and a deflection roller 11.

A sliver 12 is gripped by a driven drawing-in or feed roller 13, and is conducted to a needle-carrying or disentangling roller 14 which has a much greater peripheral speed than the feed roller 13. The separating roller 14 splits the sliver into individual fibers 15, which travel through a fiber guide channel 16 into a wedge-shaped region 17 which is defined by the outer surfaces of the drum 2 and the transport belt 8. The fiber guide channel 16 is positioned at the entrance to the wedge-shaped region, and the channel 16 has an outlet 18 which ends in the wedge-shaped region 17. The outlet 18 is directed toward the transport belt 8. Furthermore, the outlet 18 of the fiber guide channel 16 is provided with a plate or apron 19 ending in the wedge-shaped region 17 and covering the perforated drum 2.

The spinning fibers 15 fly into the wedge-shaped region 17, and partly come to lie on the transport belt 8, which directs them toward a thread 10 being formed.

During the spinning operation, the direction of rotation of the drum 2 is directed against the direction in which the spinning fibers 25 are flying, as indicated by the arrow 20. The running direction of the transport belt 8 is opposite the rotational direction of the drum 2.

Figure 3:
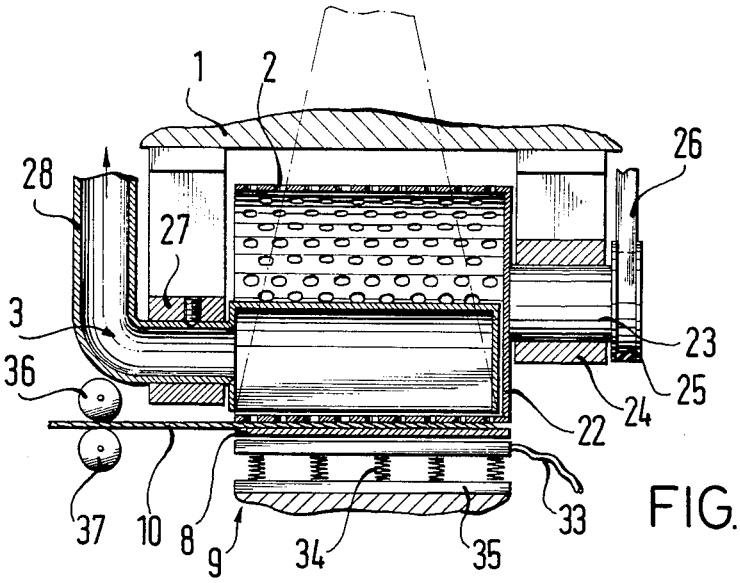
FIG. 3 is a fragmentary, longitudinal-sectional view of the device shown in FIG. 1, which is seen from the side of FIG. 1 and is additionally provided with an aero-static support.

According to FIG. 3, the perforated drum 2 is open at one end and is closed by a cover 22 at the other end thereof.

A shaft 23 is connected to the cover 22. The shaft 23 is floatingly supported or over-mounted in a stationary bearing 24. A belt pulley 25 is disposed at the end of the shaft 23 and is set in rotation by a belt 26. The suction device 3 is inserted into the perforated drum 2 from the open end, and is held in its position by a stationary holder 27. A suction line 28 connects the suction device 3 with an external suction source.

Figure 2:
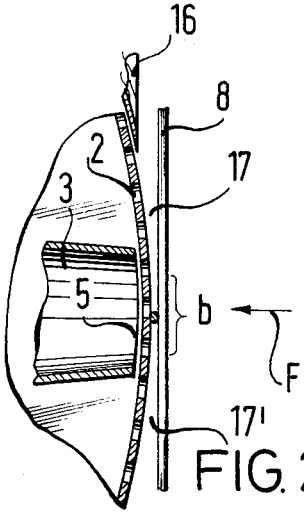
FIG. 2 is an enlarged cross-sectional view of a part of the device of FIG. 1.
Figure 5:
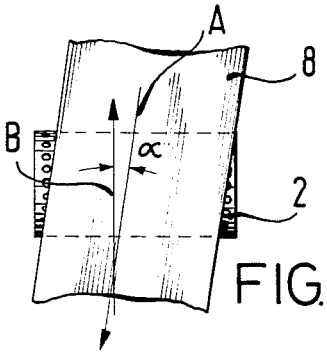
FIG. 5 is a graph showing the directions of the motion with a crossed disposition of the thread forming elements.

The suction pressure existing at the suction opening 5 of the suction device 3, the width of the suction opening 5, the mechanical tension and elasticity of the transport belt 8, and the distance from the belt 8 to the drum 2, are adjusted relative to each other in such a way that during the spinning operation a mechanical contact between the drum 2 and the transport belt 8 is prevented, but contact between both of these parts and the thread 10 is permitted. As shown in FIG. 2, the suction opening 5 is wider than a part b of the belt 8 of the wedge forming device 7 which acts on the thread 10. In particular, the part b is just wide enough, so that the suction opening 5 covers the ends of the wedge-shaped region 17 and another wedge-shaped region 17' below the thread 10.

The flying spinning fibers which are introduced enter into the wedge-shaped region and onto the transport belt, and from there they travel to a spinning line lying in the wedge-shaped region, where the thread 10 is being formed and is being continuously pulled out by rollers 36, 37.

Figure 4:
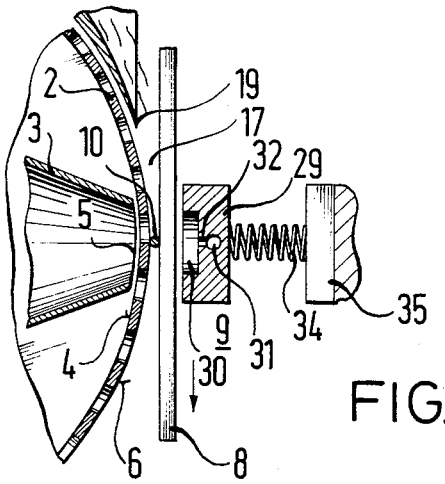
FIG. 4 is a view similar to FIG. 2, which is also additionally provided with an aero-static support.

In the second embodiment according to FIGS. 3 and 4, the transport belt 8 is provided with a device 9 which exerts a force F onto the belt 8 of the wedge forming device 7, in the direction shown in FIG. 2. The device 9 is formed of an aero-static support which is disposed opposite the drum 2 behind the transport belt 8, and which automatically loads the transport belt 8 with an adjustable force. The aero-static support 9 is provided with a plate 29 which extends parallel to the axis of the drum. The plate 29 is subdivided or compartmentalized into several chambers 30 which are open at one side thereof. The chambers 30 are disposed in a row one after the other. The openings of the chambers 30 are directed toward the rear side of the transport belt 8. All of the chambers 30 are supplied with compressed air. The compressed air is supplied through a channel 31 which is connected to the respective chambers 30 by bores 32. According to FIG. 3, a compressed air hose 33 is attached to the channel 31. The action of the force F is obtained by means of a row of adjustable compression springs 34. The compression springs 34 are disposed between a stationary yoke 35 and the plate 29.

During the spinning operation, the plate 29 makes no contact with the transport belt 8 due to the air escaping over the edges of the chambers 30.

Inasmuch as the motions of the drum and the belt of the wedge forming device are in opposite directions, the axes of rotation of the drum 2, the drive roller 38, and the deflection roller 11 are parallel. However, it is advantageous for forming of the thread, if, according to claim 5, the direction of motion A of that part, strand or trunk of the transport belt 8 which is adjacent the drum 2, runs at a crossing or longitudinal dihedral angle $\alpha$ with respect to the direction of the motion B of the parts of the outer wall 6 of the drum 2 adjacent the transport belt 8. This measure also improves the thread withdrawal. The crossing is achieved by the provision that the axes of rotation of the drive roller and the deflection roller of the transport belt 8 are not disposed parallel to the axis of rotation of the drum 2.

The invention is not limited to the illustrated and described embodiments which are used as examples. If the thread 10 is only formed by the spinning fibers supplied, the result is a simple OE-yarn or thread. If a thread or filament is conducted along the friction line during the spinning operation, the result is an OE-mantle yarn formed of a core surrounded by a thread formation or binding with the spinning fibers tied or bound together with a real twist.

Applications can be visualized in which it is more practical to rotate the perforated drum in the direction of the fiber supply flow, and to rotate the belt of the wedge forming device against the direction of the fiber flow, as opposed to the embodiments shown.

I claim:

1. Spinning device for producing an at least partially twisted spun thread formed of spinning fibers, comprising a perforated drum having a given axis of rotation about which said drum rotates in a given direction, a suction device disposed at least partially in said drum having at least one suction opening formed therein extended substantially parallel to said given axis of said drum, means disposed opposite said at least one suction opening outside said drum for forming a wedge-shaped path for the spinning fibers, means for conducting flying spinning fibers to said wedge-shaped path, and means for withdrawing a spun thread in a thread withdrawal direction substantially parallel to said axis of said drum, said wedge-shaped path forming means including an endless transport belt moving in a direction opposite said given direction and transverse to said thread withdrawal direction at a distance from said drum during spinning.

2. Spinning device according to claim 1, wherein a portion of said transport belt adjacent said drum moves in a direction forming a longitudinal dihedral angle with the direction of movement of portions of the surface of said drum adjacent said transport belt.

3. Spinning device according to claim 1, wherein a part of said transport belt with a given width acts on the thread, and said suction opening is wider than said given width.

4. Spinning device according to claim 1, wherein said transport belt has a side facing away from said drum, and including an aero-static support disposed at said side of said transport belt opposite said drum.

5. Spinning device according to claim 4, wherein said aero-static support includes a plate having chambers formed therein subdividing said plate with openings formed in one side of said plate directed toward said side of said transport belt, and means for supplying compressed air to said chambers.

6. Spinning device according to claim 1, wherein said wedge-shaped path has an inlet as seen in fiber travel direction, and said conducting means are in the form of a fiber guidance channel disposed at said path inlet, said fiber guidance channel having an outlet end disposed in said wedge-shaped path and directed toward said transport belt.

7. Spinning device according to claim 6, wherein said fiber guidance channel includes a plate disposed at said outlet, ending in said wedge-shaped path and covering part of said perforated drum.

8. Spinning device according to claim 1, wherein said wedge-shaped path is defined by said drum, said transport belt and said conducting means.

* * * * *